US009855582B2

(12) United States Patent
Pham et al.

(10) Patent No.: US 9,855,582 B2
(45) Date of Patent: Jan. 2, 2018

(54) VISCOUS FLUID APPLICATOR

(71) Applicant: The Boeing Company, Chicago, IL (US)

(72) Inventors: Rosemary Danielle Pham, Everett, WA (US); Tho Ngoc Dang, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 148 days.

(21) Appl. No.: 14/703,806

(22) Filed: May 4, 2015

(65) Prior Publication Data

US 2016/0325304 A1 Nov. 10, 2016

(51) Int. Cl.
*B05D 1/42* (2006.01)
*B05C 17/005* (2006.01)

(52) U.S. Cl.
CPC ..... *B05D 1/42* (2013.01); *B05C 17/00503* (2013.01); *B05C 17/00516* (2013.01)

(58) Field of Classification Search
CPC combination set(s) only.
See application file for complete search history.

(56) References Cited

U.S. PATENT DOCUMENTS 2,402,310 A * 6/1946 Beaumier ..... B05B 15/0233 222/506
2,713,694 A * 7/1955 Soldan ..... F16N 3/04 15/104.94
3,140,504 A * 7/1964 Knops ..... E04F 21/00 401/193
4,135,651 A * 1/1979 Hession ..... E04G 21/20 118/412
4,778,642 A 10/1988 Lee et al.
4,964,362 A 10/1990 Dominguez
5,908,644 A 6/1999 Poole
5,984,557 A * 11/1999 Fennell ..... B05C 17/00516 401/193
6,001,181 A 12/1999 Bullen
6,276,858 B1 * 8/2001 Kennedy ..... B05C 17/00516 401/193
7,963,246 B1 6/2011 Brinker
(Continued)

FOREIGN PATENT DOCUMENTS

DE 951478 C 10/1956
DE 202008003757 U1 9/2009
(Continued)

OTHER PUBLICATIONS

U.S. Patent and Trademark Office, Nonpublished U.S. Appl. No. 14/703,779, filed May 4, 2015, by Applicant, The Boeing Company.
(Continued)

*Primary Examiner* — David Walczak
(74) *Attorney, Agent, or Firm* — Kolisch Hartwell, P.C.

(57) ABSTRACT

A variable-width viscous fluid applicator, and related methods, may include an applicator having wall portions adjustable toward and away from each other, an injection port being formed in a bridge portion that spans upper ends of the wall portions. The applicator may be engaged around the edge of a component such as a panel. A bead of viscous fluid may be applied and shaped by injecting the fluid through the injection port and moving the applicator along the panel edge.

14 Claims, 10 Drawing Sheets

(56) References Cited

U.S. PATENT DOCUMENTS

| | | | |
|---|---|---|---|
| 8,651,046 | B1 | 2/2014 | Davancens et al. |
| 9,016,530 | B2 | 4/2015 | Topf et al. |
| 2008/0128430 | A1 | 6/2008 | Kovach et al. |
| 2013/0207348 | A1 | 8/2013 | Smeets |
| 2016/0279863 | A1 | 9/2016 | Trend et al. |

FOREIGN PATENT DOCUMENTS

| | | | |
|---|---|---|---|
| EP | 0889108 | A1 | 1/1999 |
| EP | 2837430 | A2 | 2/2015 |
| GB | 2524508 | A | 9/2015 |
| WO | 0226397 | A1 | 4/2002 |
| WO | 2012084238 | A1 | 6/2012 |
| WO | 2014063806 | A1 | 5/2014 |
| WO | 2014179015 | A1 | 11/2014 |

OTHER PUBLICATIONS

European Patent Office, Extended European Search Report in European Patent Application No. 16162094.3-1760, dated Aug. 10, 2016, 6 pages.

U.K. Intellectual Property Office, Combined Search and Examination Report under Sections 17 and 18(3) in UK Patent Application No. GB1609279.3, dated Nov. 10, 2016, 6 pages.

* cited by examiner

VISCOUS FLUID APPLICATOR

FIELD

This disclosure relates to the application of viscous fluids to components. More specifically, the disclosed embodiments relate to apparatuses and methods for the application of viscous fluids to components having varying widths and/or contours.

INTRODUCTION

Viscous fluids, such as sealants and adhesives, may be applied on various components during industrial manufacturing and other operations. For example, beads of sealant or adhesive may be applied to composite materials during assembly of larger structures, to prevent corrosion and/or insulate edges (e.g., to mitigate the electrical properties of the composite materials, to prevent electrostatic discharge, etc.). These components, however, may have varying widths and/or contours. To address the varying widths and/or contours while maintaining tight quality tolerances, viscous fluids have typically been manually applied to such components. For example, seal guns, nozzles, putty knives, rags, users' fingers, and/or harsh solvents may be used to manually apply, shape, and clean up the fluid. Such manual application is generally tedious, time-consuming, wasteful, and/or less than efficient.

SUMMARY

The present disclosure provides systems, apparatuses, and methods relating to viscous fluid application and shaping. In some embodiments, an applicator device may include a first applicator portion including a generally vertical first wall portion having a first inner face and a roof portion extending substantially orthogonally from the first wall portion; a second applicator portion including a generally vertical second wall portion having a second inner face, the second applicator portion slidably coupled with the first applicator portion, such that the first and second applicator portions are in an opposing spaced-apart arrangement; and a seating member extending inwardly from at least one of the first and second inner faces, the seating member configured to contact an edge surface of a panel; such that a bead or coating of fluid on the edge surface of the panel is shaped into a selected cross section at least in part by a contour of the roof portion when the first and second applicator portions are passed along the panel with the seating member and at least a portion of the first and second inner faces in contact with the panel.

In some embodiments, a variable-width nozzle for applying and shaping a viscous fluid may include an applicator having an opposing pair of generally parallel side walls adjustable toward and away from each other, and a bridge portion spanning upper ends of the pair of side walls; a nozzle region formed by inner surfaces of the bridge portion and the side walls; and an injection port formed in the bridge portion, such that an upper exterior of the bridge portion is in fluid communication with the nozzle region.

In some embodiments, a method for applying and shaping a viscous fluid on a panel edge may include placing an adjustable applicator onto an edge of a panel such that the edge of the panel is between opposing walls of the applicator and below a bridge portion of the applicator, the bridge portion spanning the opposing walls; adjusting the opposing walls such that the opposing walls are in contact with opposing faces of the panel; injecting a viscous fluid into a port in the bridge portion of the applicator, such that the viscous fluid is deposited onto the edge of the panel; and moving the applicator along the edge of the panel, such that the viscous fluid is shaped into a selected cross section by an inner contour of the applicator.

Features, functions, and advantages may be achieved independently in various embodiments of the present disclosure, or may be combined in yet other embodiments, further details of which can be seen with reference to the following description and drawings.

DESCRIPTION

Definitions

"Bead" refers to a band of viscous fluid that is supported by and/or on a component (e.g., a panel). A viscous fluid applicator in accordance with aspects of the present disclosure may be configured to produce a bead of any suitable cross-sectional dimensions (e.g., any suitable aspect ratio). For example, the bead may have a low-aspect ratio cross section (e.g., one or more thick layers) or a high-aspect ratio cross section (e.g., one or more thin layers). The bead may be supported on one or more surfaces of a component, such as on only a primary surface, on only a primary surface and one or more opposed surface, etc.

"Viscous fluid" refers to a flowable material having a viscosity sufficient to substantially retain shape in the absence of applied stress. For example, viscous fluids may be formed into a bead having a selected cross section.

Viscous fluids may include semisolid materials. Examples of viscous fluids include certain caulks, sealants, epoxies, adhesives, and the like. The systems and methods described herein may be used with any suitable viscous fluid. One suitable, non-limiting example is a flexible epoxy adhesive having a viscosity of approximately 80,000 cP at room temperature.

Overview

Various embodiments of a viscous fluid applicator having a variable geometry (e.g., an adjustable width), as well as related methods, are described below and illustrated in the associated drawings. Unless otherwise specified, a viscous fluid applicator and/or its various components may, but are not required to, contain at least one of the structure, components, functionality, and/or variations described, illustrated, and/or incorporated herein. Furthermore, the process steps, structures, components, functionalities, and/or variations described, illustrated, and/or incorporated herein in connection with the present teachings may, but are not required to, be included in other similar applicators. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Figure 1:
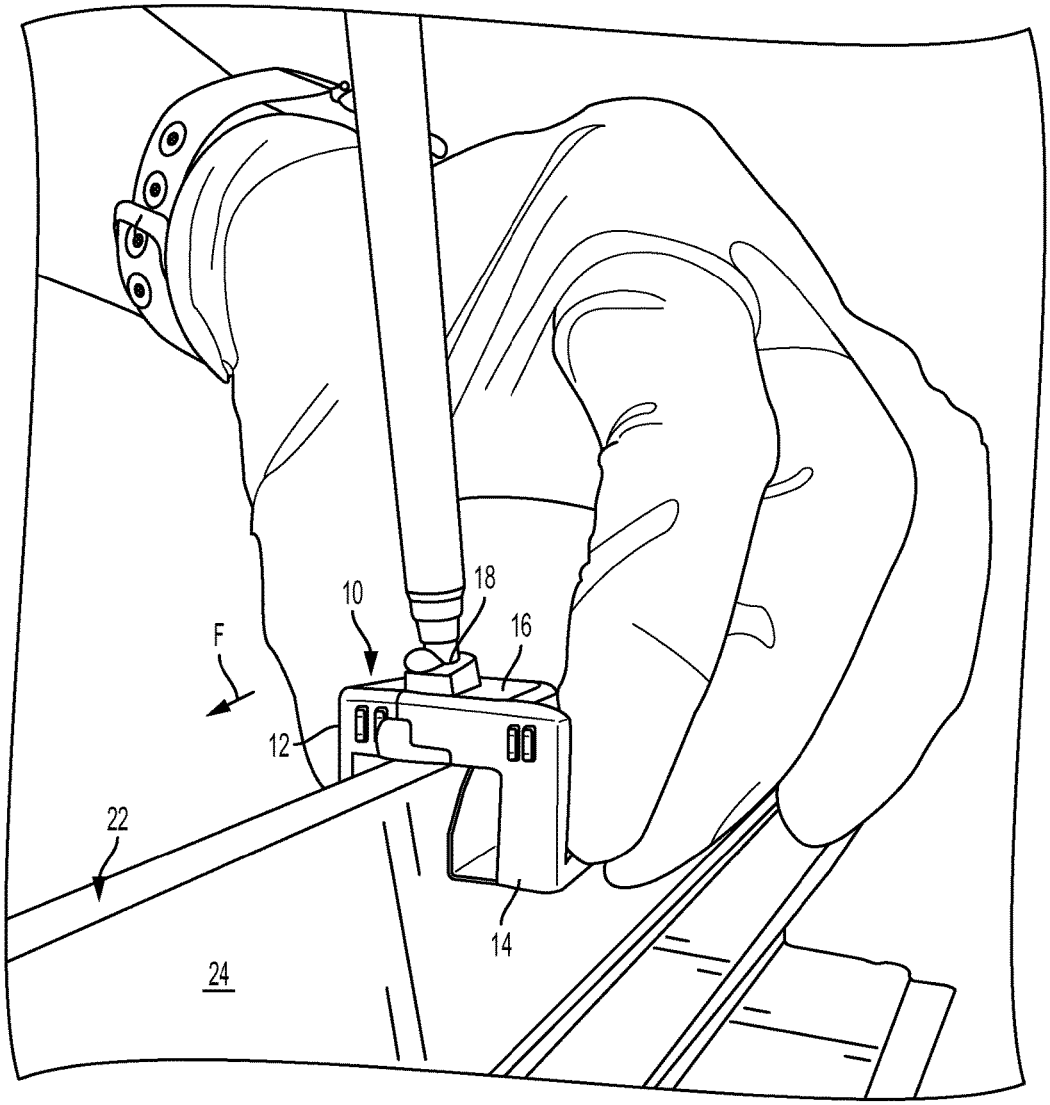
FIG. 1 depicts an illustrative applicator being used in accordance with aspects of the present disclosure with an illustrative panel.

In general, and with reference to FIG. 1, a viscous fluid applicator 10 may include an opposing pair of generally parallel side wall portions 12, 14 that are adjustable toward and away from each other. Side wall portions 12 and 14 may be referred to more simply as side walls. A bridge portion 16 (also referred to as a roof portion) spans upper ends of the pair of side walls. Inner surfaces of the bridge portion and the side walls form a nozzle region. An injection port 18 may be formed in the bridge portion, such that an upper exterior of the bridge portion is in fluid communication with the nozzle region. As shown in FIG. 1, the viscous fluid 20 may be injected through port 18 and thereby forced through the nozzle region under the bridge portion. For example, the viscous fluid may be applied to an edge surface 22 of a panel 24 (e.g., a carbon fiber—reinforced polymer (CFRP) panel) by injecting it through port 18 and onto the edge surface. Furthermore, applicator 10 may be moved along the edge of panel 24 in the direction indicated by arrow F, such that viscous fluid 20 is shaped into a selected cross section by an inner contour of the applicator (i.e., the nozzle region). Opposing walls 12, 14 may be adjusted such that at least a portion of the opposing walls are in contact with opposing faces of panel 24. Adjustment may be achieved, for example, by squeezing or otherwise manually forcing the walls toward the panel, as shown in FIG. 1.

Figure 2:
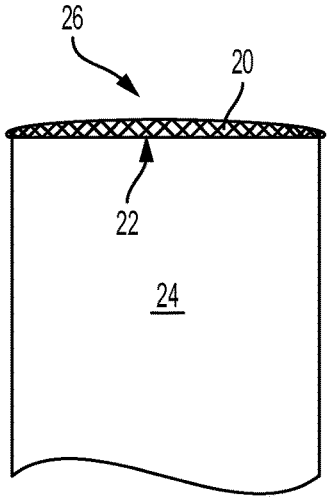
FIG. 2 is a sectional view depicting an illustrative bead of viscous fluid on an edge surface of a panel.

The inner contour of the nozzle region of applicator 10 may be selected depending on a selected or predetermined cross section of the corresponding bead. An illustrative sectional view of a bead 26 of viscous fluid 20 is shown in FIG. 2. Bead 26 is disposed on edge surface 22 of panel 24, after having been deposited and shaped by applicator 10.

Examples, Components, and Alternatives

The following sections describe selected aspects of exemplary viscous fluid applicators, as well as related systems and/or methods. The examples in these sections are intended for illustration and should not be interpreted as limiting the entire scope of the present disclosure. Each section may include one or more distinct examples, and/or contextual or related information, function, and/or structure.

Section 1:

As shown in FIGS. 3-9, this section describes an applicator device 30. Applicator device 30 is an example of viscous fluid applicator 10, described above. Accordingly, similar components may be labeled with similar reference numbers.

Figure 3:
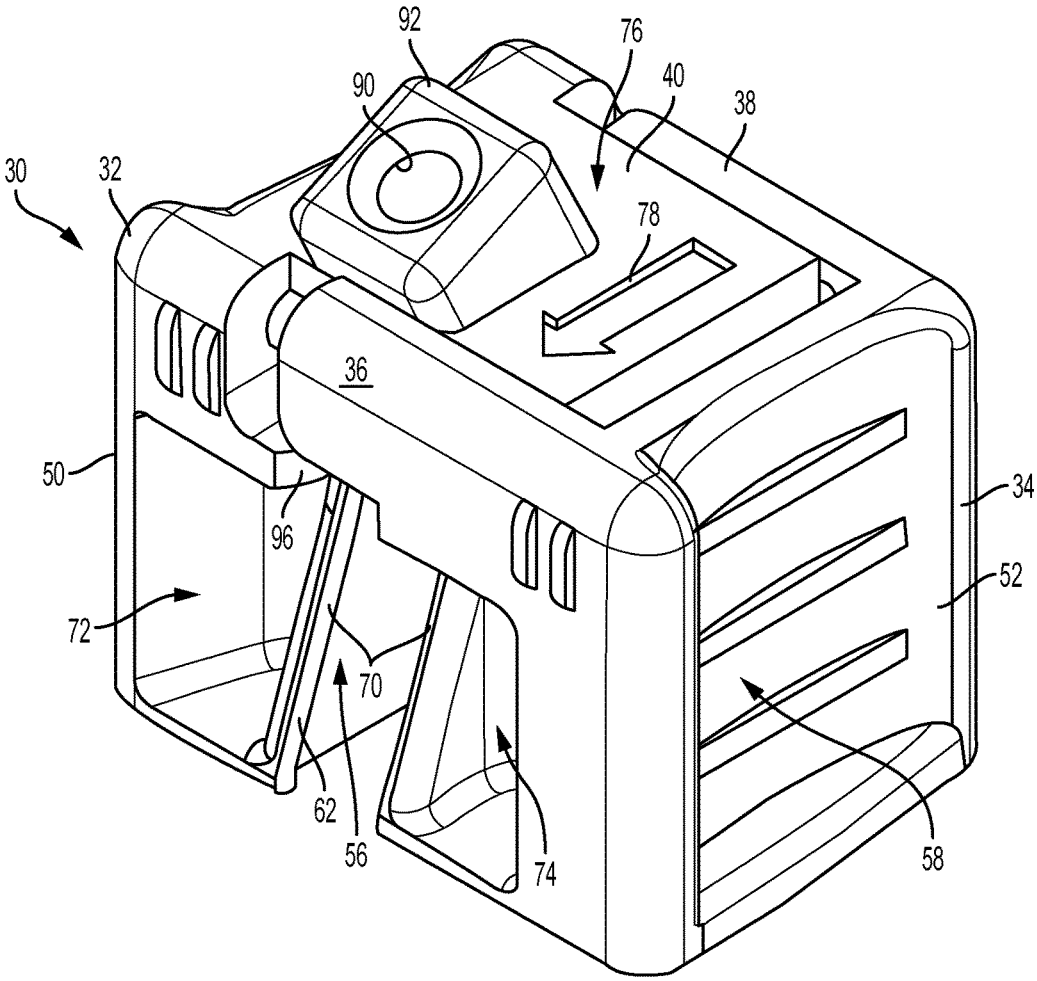
FIG. 3 is an isometric view of an illustrative applicator in accordance with aspects of the present disclosure, taken from a front angle.
Figure 4:
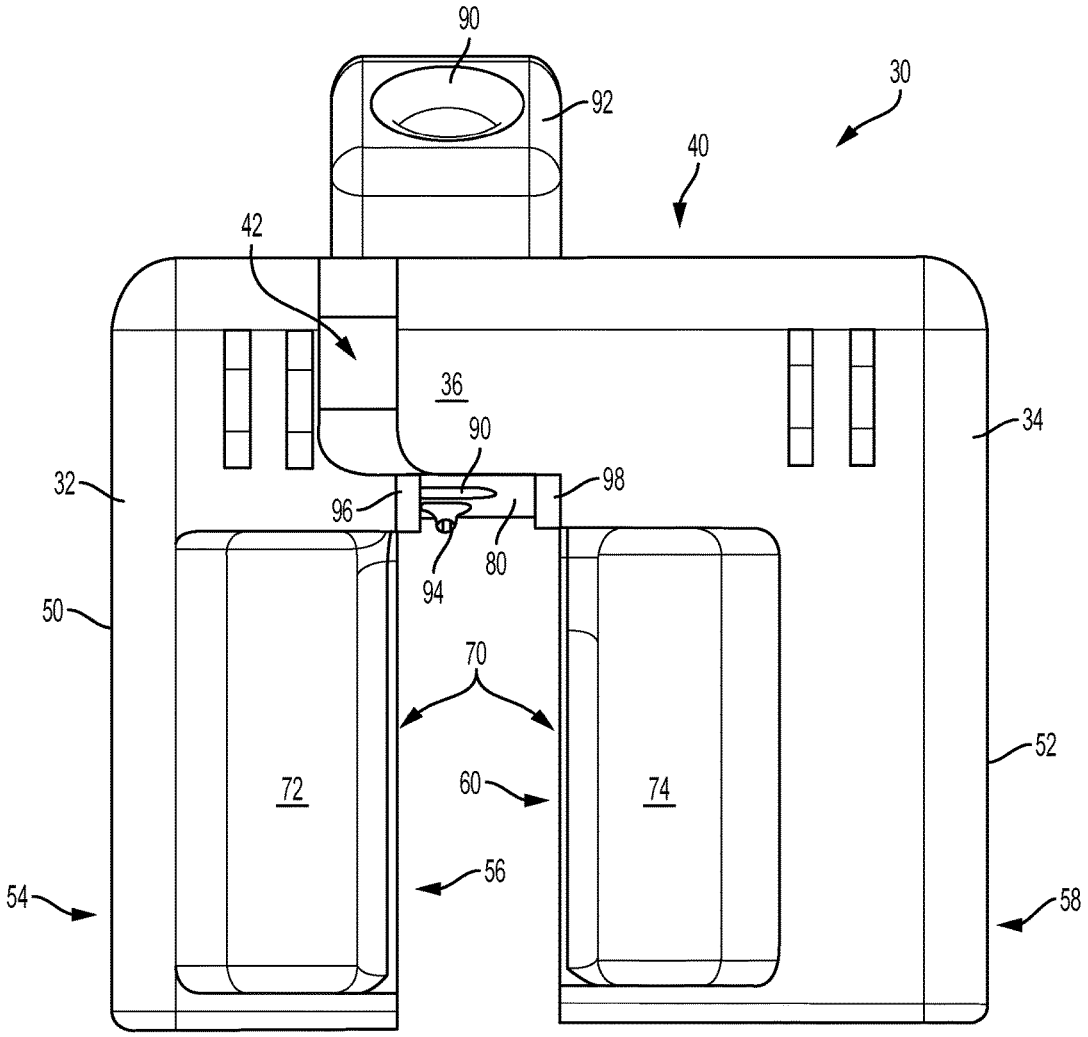
FIG. 4 is a front elevation view of the applicator of FIG. 3.
Figure 5:
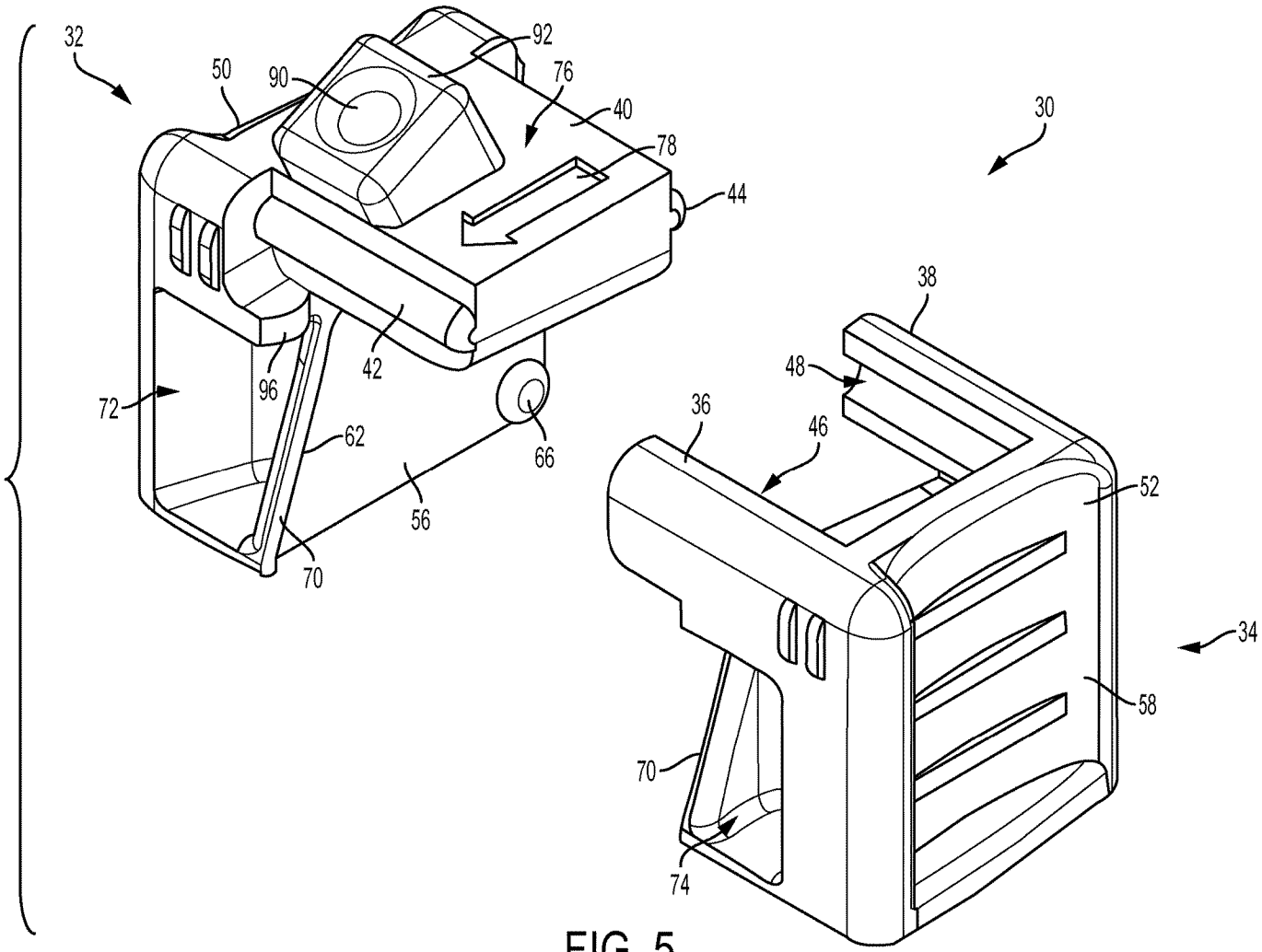
FIG. 5 is an exploded isometric view of the applicator of FIG. 3.
Figure 6:
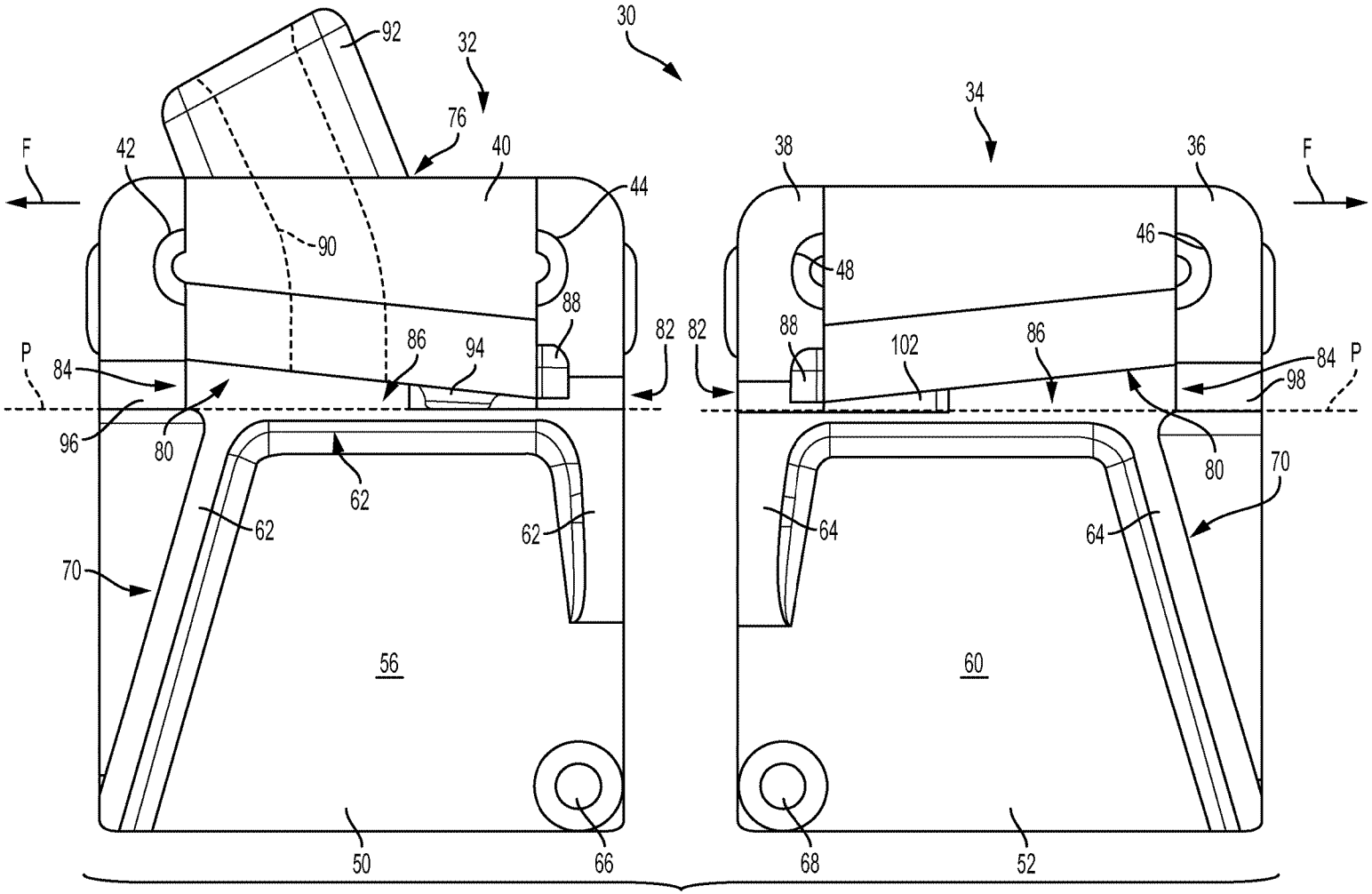
FIG. 6 is an exploded side elevation view of the applicator of FIG. 3, with the two portions of the applicator turned to show respective inner faces.
Figure 7:
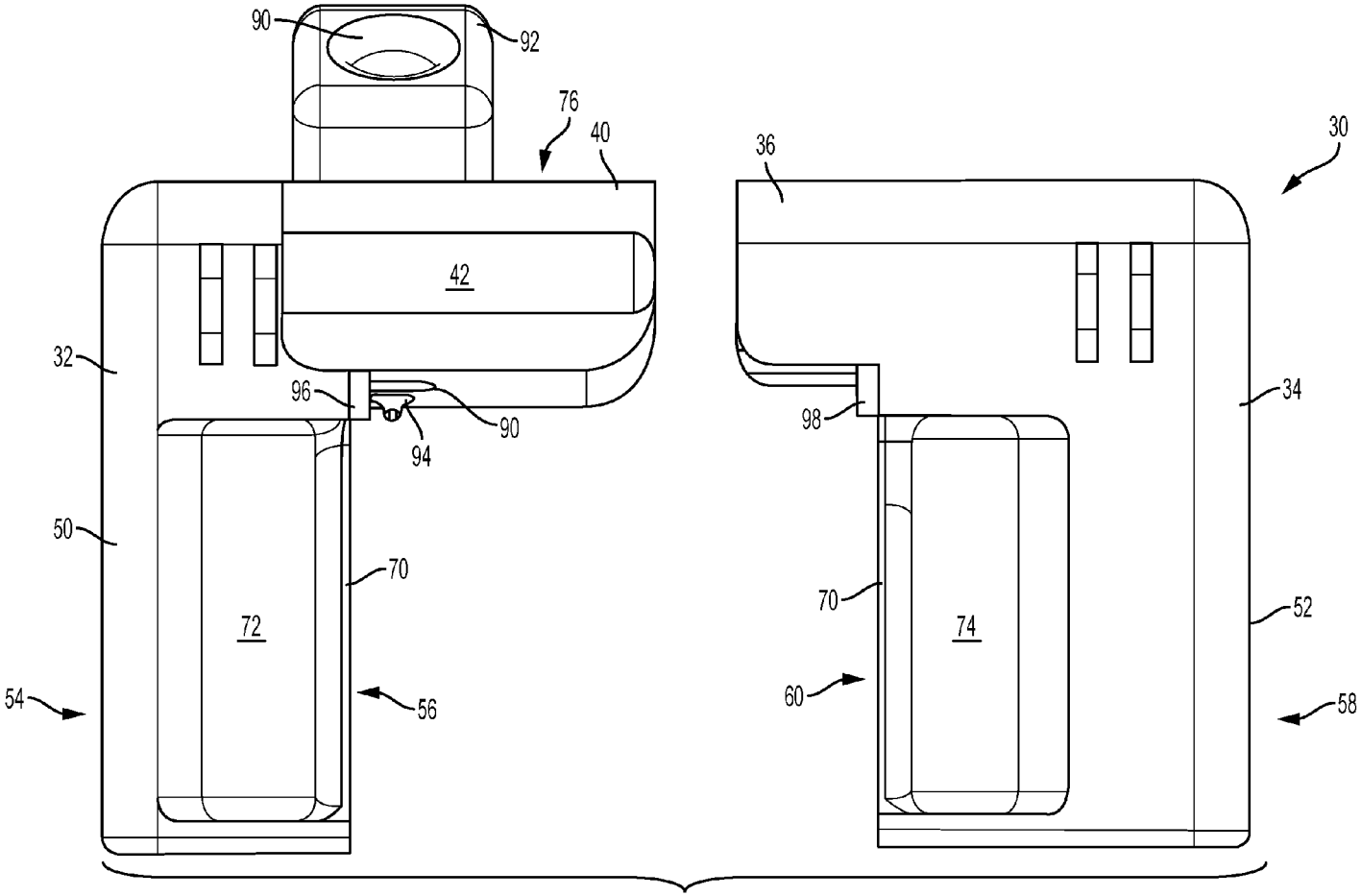
FIG. 7 is an exploded front elevation view of the applicator of FIG. 3.
Figure 8:
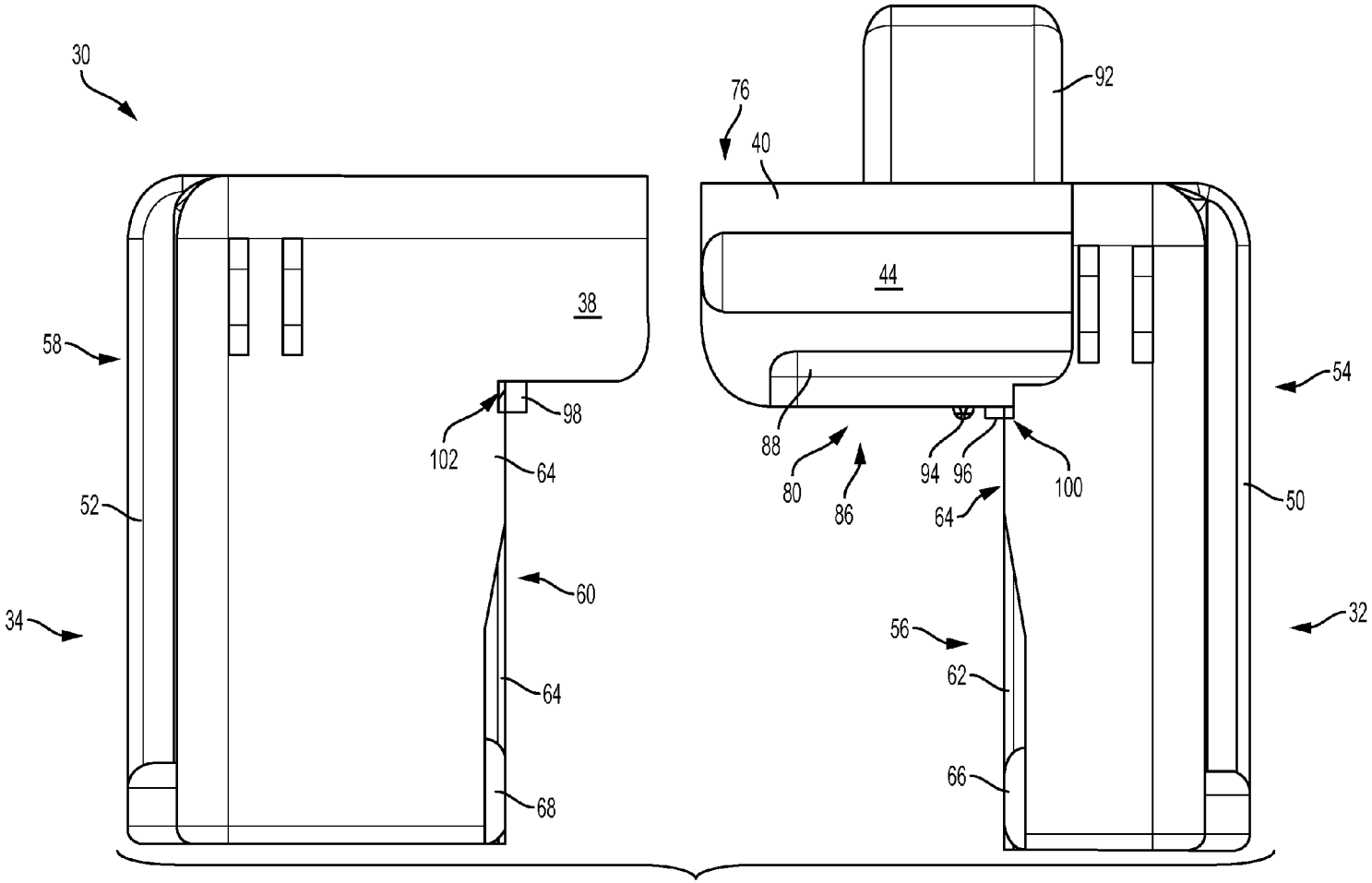
FIG. 8 is an exploded rear elevation view of the applicator of FIG. 3.
Figure 9:
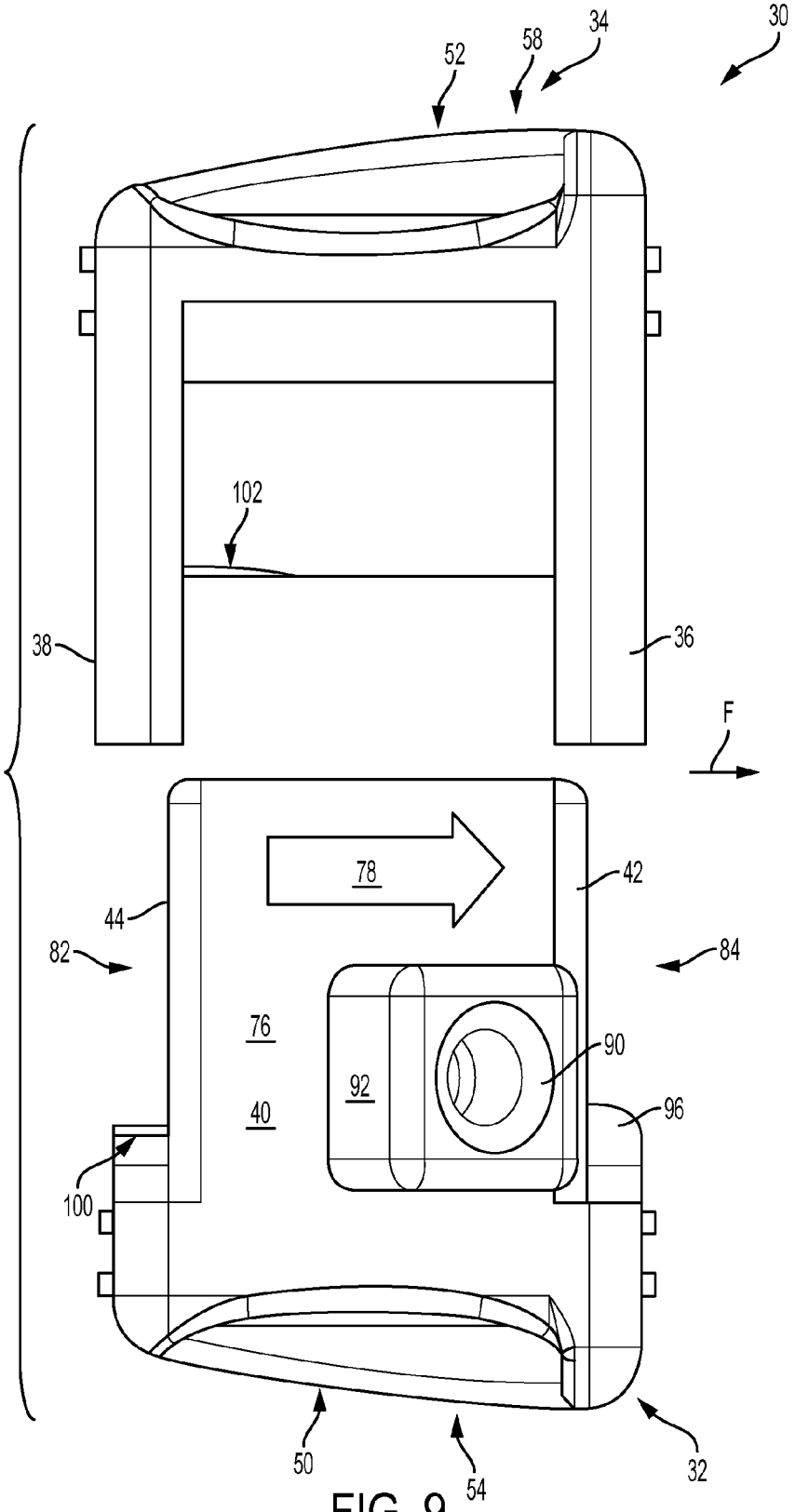
FIG. 9 is an exploded overhead plan view of the applicator of FIG. 3.

FIG. 3 is an isometric view of applicator device 30, depicted from a front, downwardly oblique angle. FIG. 4 is a front elevation view of applicator device 30. FIG. 5 is the view of FIG. 3, but showing device 30 in an exploded configuration. FIG. 6 is a side elevation view of device 30, with the two main portions turned to show respective inner faces. FIG. 7 is an exploded front elevation view, and FIG. 8 is an exploded rear elevation view. Finally, FIG. 9 is an exploded overhead plan view of device 30.

Applicator device 30 includes a first applicator portion 32 and a second applicator portion 34. Portions 32 and 34 are slidably coupled to each other, meaning the applicator is adjustable by sliding the portions toward and away from each other. In the embodiment of FIGS. 3-9, this coupling is achieved by a pair of engagement arms 36, 38 extending from the upper end of second applicator portion 34.

Engagement arms 36 and 38 are configured to engage in a friction fit with corresponding engagement structures on a bridge portion 40. Bridge portion 40 extends from an upper end of first applicator portion 32. As best viewed in FIG. 5, bridge portion 40 includes a pair of elongate projections 42 and 44, which are configured to friction fit in sliding engagement with corresponding channels 46 and 48 in arms 36 and 38, respectively.

Each applicator portion includes a side wall, 50 and 52. Side walls 50 and 52 include the block-like, generally rectangular, generally vertical side portions that extend downward from the bridge portion and engagement arms. Bridge portion 40 spans upper ends of the pair of side walls.

Side wall 50 is affixed to bridge portion 40. Side wall 50 includes an outer face 54 contoured and textured for manual gripping, and an opposite inner face 56 configured to contact the face of a panel. Likewise, side wall 52 includes an outer face 58 contoured and textured for manual gripping, and an inner face 60 configured to contact the face of the panel. When applicator portions 32 and 34 are engaged, side walls 50 and 52 are oriented generally parallel to each other in an opposing, spaced apart arrangement. Accordingly, the side walls are configured to wrap around the edge of a panel placed therebetween (as shown in FIG. 1).

Inner face 56 includes a first raised ridge portion 62, and inner face 60 includes a second raised ridge portion 64. Ridge portions 62 and 64 may be substantially identical, mirror images, although other configurations are possible. Each ridge portion includes a raised surface that runs at least partially along a perimeter of the corresponding inner face. The ridge portions may include any suitable raised surface configured to be placed in contact with the face of a panel (e.g., panel 24) while reducing frictional contact area and facilitating sliding motion between the surface and the face of the panel.

Ridge portions 62 and 64 may provide stable lateral contact between the applicator portions and the panel. In the embodiment depicted in FIGS. 3-9, however, frictional contact may be further reduced by excluding the ridge portions from the bottom perimeter and part of the rear perimeter. This further reduction may be at the expense of stability. Accordingly, a pair of raised buttons 66 and 68 may be included on inner faces 56 and 60 to limit friction while also ensuring stable contact. Buttons 66 and 68 may be any shape and size. In the embodiment shown in FIGS. 3-9, buttons 66 and 68 are round protrusions having a height substantially equivalent to the height of the ridge portions.

Ridge portions 62 and/or 64 may also form a scraper 70 on the leading edges of applicator portions 32 and 34. In other embodiments, scraper 70 may be only partially formed by (or formed independently of) ridge portions 62 and 64. Scraper 70 may include any suitable structure configured to remove extraneous fluid from an adjacent major face of the panel. For example, scraper 70 includes a pair of flat strips extending at an angle along the leading edge of the side walls. Scraper 70 may be angled such that a lower end of the scraper is farther forward than an upper end, as shown in FIG. 5. This configuration may facilitate urging fluid in a generally upward direction. The scraper is configured to lie flat against the panel surface, such that movement of the applicator along the panel causes the scraper to be in continuous contact with the panel, thereby removing (e.g., pushing aside) any substance in the path of the scraper.

Substances (e.g., viscous fluids) removed by scraper 70 may be collected, at least partially, in one or more recesses in the applicator portions adjacent to the scraper. In other words, the recesses are configured to receive extraneous fluid removed by the scraper. For example, a pair of recesses 72 and 74 may be disposed on leading faces of applicator portions 32 and 34, respectively.

Bridge portion 40 (also referred to as a roof portion, a roof, or a bridge) extends substantially orthogonally from first side wall 50. Bridge portion 40 has an upper exterior surface 76, on which an arrow 78 is inscribed or otherwise included. Arrow 78 indicates the direction of travel, allowing a user to easily determine which way the device should be passed along a panel edge. This direction also continues to be indicated by reference arrow F in the various drawings, as an aid to understanding.

An underside of bridge portion 40 includes a contoured ceiling 80 that is configured to form the bead of viscous fluid as described further above and below. For reference, a dashed line P is included in FIG. 6 to indicate where the edge surface of a panel will be located relative to device 30. Ceiling 80 is sloped (i.e., angled) such that a trailing end 82 of the ceiling is closer to edge surface 22/P than a leading end 84. Trailing end 82 may also be referred to as the exit or exit end, as the viscous fluid is expected to exit the device at that end.

The volume or space defined by ceiling 80, panel edge surface 22/P, and the two side walls, may be referred to as a nozzle region 86. The contour of ceiling 80 transitions from sloped to flat at exit 82 of nozzle region 86. This transition may be incorporated using any suitable structure or contour. Rather than simply terminating the sloped area of the ceiling at the exit, device 30 includes an extension 88, which has a lower or bottom surface that is horizontal relative to panel edge surface 22/P. The lower surface may have a height that is a selected distance from panel edge surface 22/P corresponding to a predetermined thickness of bead 26.

Extension 88 may function to extend the life of device 30. For example, the viscous fluid may cause wear in nozzle region 86 over time, especially at trailing end 82. Accordingly, rather than including a sharp transition from angled ceiling to open air, a flat surface is extended at the same height. This allows a more prolonged transition and reduces wear at the critical termination point of the ceiling slope.

Bridge portion 40 includes an injection port 90, which is an opening passing through the bridge or roof portion, with one end terminating at ceiling 80. Injection port 90 is configured to provide fluid communication between exterior 76 and the edge surface of the panel (e.g., at P). The viscous fluid may be injected via port 90 into nozzle region 86. An upper end portion of port 90 includes a protrusion 92 angled toward a leading edge of bridge portion 40. A central axis of injection port 90 may be curved or otherwise nonlinear. This curvature may facilitate having the upper portion of the injection port at a conveniently ergonomic angle, while the lower portion of the injection port is approximately vertical or some other angle optimized for injection of the fluid into the nozzle region.

One or more features of applicator device 30 may be configured to seat the device on edge surface 22 and maintain spacing above edge surface 22/P, thereby ensuring consistent configuration of nozzle region 86. In the embodiment shown in FIGS. 3-9, these features include a keel member 94 and one or more flanges such as flange 96 and flange 98.

Keel member 94 protrudes downward from ceiling 80 (i.e., the bridge or roof portion), into nozzle region 86 near trailing edge 82. Keel member 94 includes a structure that contacts edge surface 22 and is configured to maintain a selected spacing of the rear portion of bridge 40 above the edge surface. Keel member 94 may have a hydrodynamic profile configured to allow recombination of fluid passing around the keel member before said fluid reaches exit end 82. This hydrodynamic feature ensures the keel member will not adversely affect bead 26.

Flanges 96 and 98 (also referred to as seating members) extend inwardly from the respective side walls, such as from inner face 56 and inner face 60. As depicted in FIGS. 3-9, each flange includes a projecting tab or shelf, extending partially into the gap between side walls. Flanges 96 and 98 may be sized such that frictional contact is reduced while maintaining sufficient surface contact with the edge of the panel to permit solid seating and maintenance of the seating during operational use.

As shown in FIG. 2, the illustrative bead includes a predetermined cross section wherein bead 26 overhangs panel 24 at each lateral side. In other words, the width of bead 26 is slightly greater than the width of edge surface 22. To obtain this overhang, nozzle region 86 may include a widening zone or horizontal expansion near trailing end 82, as best viewed in FIGS. 6,8, and 9. Accordingly, each side wall of device 30 includes a widening of the nozzle region, also referred to as an expansion zone, as indicated at 100 and 102.

Figure 10:
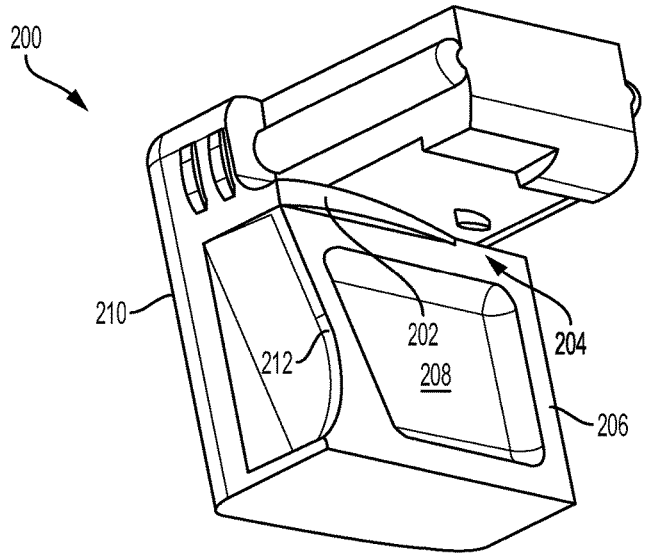
FIG. 10 is an isometric view of a portion of another illustrative applicator in accordance with aspects of the present disclosure.
Figure 11:
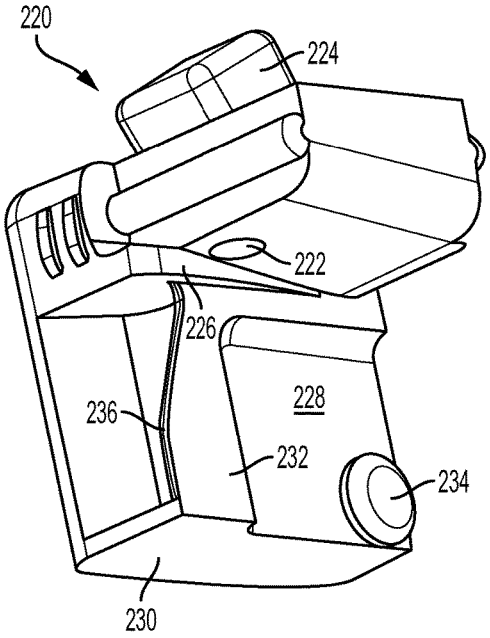
FIG. 11 is an isometric view of a portion of another illustrative applicator in accordance with aspects of the present disclosure.
Figure 12:
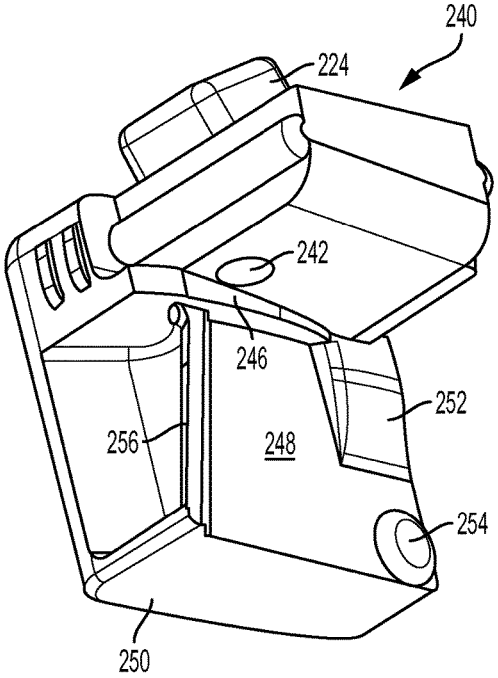
FIG. 12 is an isometric view of a portion of another illustrative applicator in accordance with aspects of the present disclosure.

Section 2:

As shown in FIGS. 10-12, this section describes additional embodiments of a viscous fluid applicator similar to applicator devices 10 and 30 above. FIGS. 10-12 depict only a first applicator portion of each embodiment. It should be understood that a respective second applicator portion corresponds to each embodiment. As substantive differences are expressed in the first applicator portions, the features of each corresponding second applicator portion should be clear to one skilled in the art, especially taking the descriptions below in combination with those of second applicator portion 34.

FIG. 10 depicts a viscous fluid applicator 200 similar to applicator 30. Several differences in features are present in applicator 200, as compared with applicator 30. For example, applicator 200 does not include an injection port. Accordingly, applicator 200 may be utilized as a shaping tool, by first laying down a quantity of viscous fluid, and then running applicator 200 along the edge of the panel to shape the bead.

Applicator 200 includes an elongate flange 202 that is shaped to form an expansion zone 204 the nozzle region. Flange 202 fulfills the function of flanges 96 and 98 above, in addition to the function of expansion zones 100 and 102. Applicator 200 includes a ridge portion 206 on an inner face 208 of side wall 210. Ridge portion 206, in this embodiment, is completely perimetrical. Ridge portion 206 forms a scraper 212 on a leading edge of the side wall. Unlike scraper 70, scraper 212 is at least partially curved.

FIG. 11 depicts a viscous fluid applicator 220 similar to applicator 30. As with applicator 200, several differences in features are present in applicator 220, as compared with applicator 30. For example, although applicator 220 includes an injection port 222 and corresponding projection 224, applicator 220 does not include a keel member (e.g., keel member 94). Accordingly, an elongate flange 226 extends along an inner face 228 of side wall 230, and functions to support the nozzle region above a panel edge. Flange 226 extends forward to a greater extent than flanges 96, 98, and 202, to provide additional support and stability.

Applicator 220 includes a ridge portion 232 extending along two edges of the side wall, and a raised button 234 substantially larger than button 68. Ridge portion 232 forms a scraper 236 having a non-linear profile.

FIG. 12 depicts a viscous fluid applicator 240 similar to applicator 30. Several differences in features are present in applicator 240, as compared with applicator 30. For example, although applicator 240 includes an injection port 242 and corresponding projection 244, applicator 240 does not include a keel member (e.g., keel member 94). Accordingly, an elongate flange 246 extends along an inner face 248 of side wall 250, and functions to support the nozzle region above a panel edge. Similar to flange 226, flange 246 extends forward to a greater extent than flanges 96, 98, and 202, to provide additional support and stability.

Applicator 240 includes a ridge portion 252 extending along three edges of the side wall, and a raised button 254 substantially larger than button 68, but smaller than button 234. Ridge portion 252 forms a scraper 256, which has a linear profile substantially similar to scraper 70.

Figure 13:
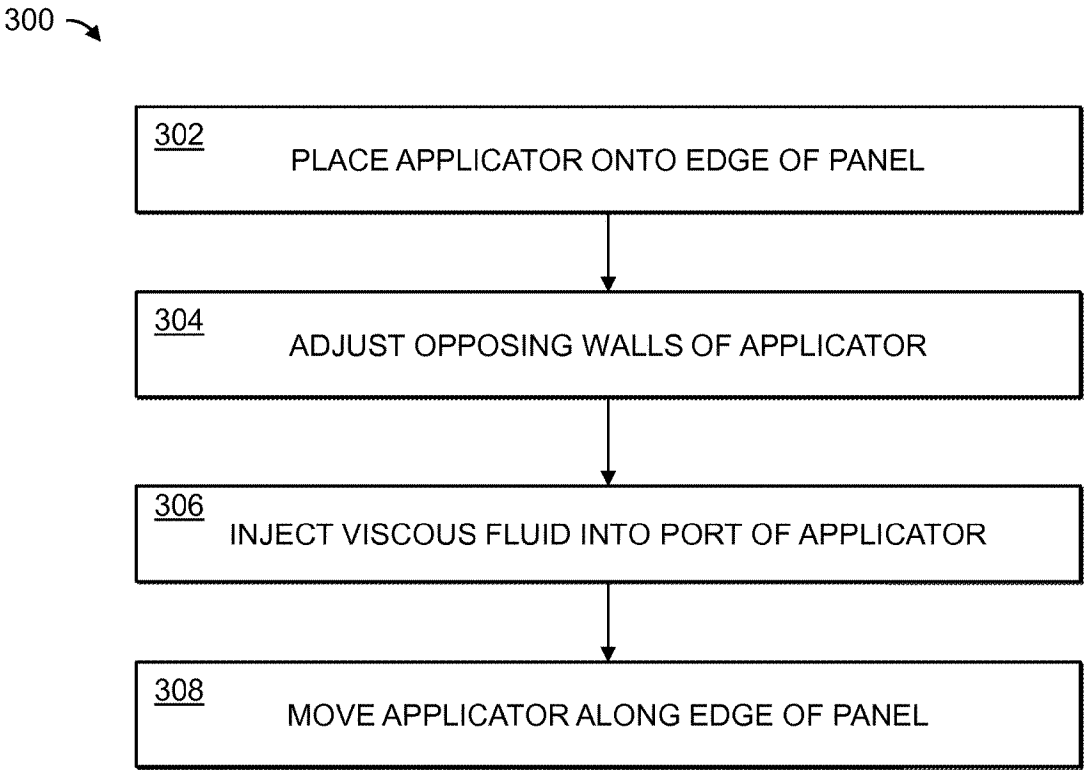
FIG. 13 is a flow chart depicting steps of a method for applying and shaping a viscous fluid on the edge of a panel or other component.

Section 3:

This section describes a method for applying and shaping a viscous fluid on a panel edge; see FIG. 13. Aspects of applicators 10, 30, 200, 220, and/or 240 may be utilized in the method steps described below. Where appropriate, reference may be made to previously described components and systems that may be used in carrying out each step. These references are for illustration, and are not intended to limit the possible ways of carrying out any particular step of the method.

FIG. 13 is a flowchart illustrating steps performed in an illustrative method, and may not recite the complete process or all steps of the program. FIG. 13 depicts multiple steps of a method, generally indicated at 300, which may be performed in conjunction with viscous fluid applicators according to aspects of the present disclosure. Although various steps of method 300 are described below and depicted in FIG. 13, the steps need not necessarily all be performed, and in some cases may be performed in a different order than the order shown.

At step 302, an adjustable applicator (e.g., applicator 10, 30) may be placed onto an edge of a panel (e.g., edge surface 22 of panel 24). The edge of the panel may be between opposing walls of the applicator (e.g., side walls 50, 52), and below a bridge portion of the applicator (e.g., bridge portion 40). The bridge portion may span the opposing walls. In some embodiments, placing the applicator onto the edge of the panel includes seating a flange of the applicator (e.g., flange 96, 98) on the edge of the panel.

At step 304, the opposing walls may be adjusted such that the opposing walls are in contact with opposing faces of the panel. In some embodiments, adjusting the opposing walls includes squeezing the opposing walls toward each other. In some embodiments, squeezing may be achieved manually, such as using two fingers of a hand.

At step 306, a viscous fluid may be injected into a port (e.g., injection port 90) in the bridge portion of the applicator, such that the viscous fluid is deposited onto the edge of the panel.

At step 308, the applicator may be moved along the edge of the panel, such that the viscous fluid is shaped into a selected cross section by an inner contour of the applicator. In some embodiments, injecting the viscous fluid is performed while moving the applicator along the edge of the panel. In some embodiments, moving the applicator along the edge of the panel includes maintaining at least a portion of the opposing walls in contact with the opposing faces of the panel.

Method 300 may include scraping excess fluid from one or more of the faces of the panel using one or more leading edges of the opposing walls of the applicator (e.g., scraper 70).

Method 300 may include shaping the viscous fluid into the predetermined cross section in part by a sloping ceiling formed by the bridge portion (e.g., ceiling 80). The viscous fluid may be shaped into the selected or predetermined cross section in part by a widening channel formed by the opposing walls (e.g., expansion zone 100, 102).

Selected Embodiments

This section describes additional aspects and features of viscous fluid applicators having a variable geometry, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. An applicator device comprising: a first applicator portion including a generally vertical first wall portion having a first inner face and a roof portion extending substantially orthogonally from the first wall portion; a second applicator portion including a generally vertical second wall portion having a second inner face, the second applicator portion slidably coupled with the first applicator portion, such that the first and second applicator portions are in an opposing spaced-apart arrangement; a seating member extending inwardly from at least one of the first and second inner faces, the seating member configured to contact an edge surface of a panel; such that a bead of fluid on the edge surface of the panel is shaped into a selected cross section at least in part by a contour of the roof portion when the first and second applicator portions are passed along the panel with the seating member and at least a portion of the first and second inner faces in contact with the panel.

A1. The device of paragraph A0, wherein the roof portion is angled such that a trailing end is configured to be closer to the panel than a leading end.

A2. The device of any of paragraphs A0 through A1, further comprising a horizontal portion at the trailing end of the roof portion, a lower surface of the horizontal portion configured to be a selected distance from the edge surface of the panel corresponding to a predetermined thickness of the bead of fluid.

A3. The device of any of paragraphs A0 through A2, the roof portion further comprising a keel member protruding downward from the roof portion, the keel member being configured to contact the edge surface of the panel to maintain a predetermined spacing of the roof portion from the edge surface.

A4. The device of paragraph A3, wherein the keel member has a hydrodynamic profile configured to allow recombination of fluid passing around the keel member before said fluid reaches an exit end of the roof portion.

A5. The device of any of paragraphs A0 through A4, the first applicator portion further comprising a ridge formed on the first inner face.

A6. The device of paragraph A5, wherein the ridge forms a scraper disposed on a leading edge of the first wall portion, the scraper being configured to remove extraneous fluid from an adjacent major face of the panel.

A7. The device of paragraph A6, the first applicator portion further comprising a recess adjacent to the scraper, the recess being configured to receive the extraneous fluid removed by the scraper.

A8. The device of any of paragraphs A0 through A7, further comprising a port formed through the roof portion, the port being configured to provide fluid communication between an exterior of the device and the edge surface of the panel.

A9. The device of paragraph A8, wherein the port has a curved central axis.

A10. The device of paragraph A8, wherein an upper portion of the port comprises a protrusion angled toward a leading edge of the roof portion.

A11. The device of any of paragraphs A0 through A10, wherein the first and second inner faces each expands outward at a trailing end of the roof portion.

B0. A variable-width nozzle for applying and shaping a viscous fluid, the nozzle comprising: an applicator including an opposing pair of generally parallel side walls adjustable toward and away from each other, and a bridge portion spanning upper ends of the pair of side walls; a nozzle region formed by inner surfaces of the bridge portion and the side walls; and an injection port formed in the bridge portion, such that an upper exterior of the bridge portion is in fluid communication with the nozzle region.

B1. The nozzle of paragraph B0, each of the side walls further including a scraper on a leading edge.

B2. The nozzle of any of paragraphs B0 through B1, wherein the injection port includes an opening in a ceiling portion of the nozzle region, and the ceiling portion slopes downward from the opening toward an exit portion of the nozzle region.

B3. The nozzle of paragraph B2, wherein a contour of the ceiling portion transitions from sloped to flat at the exit portion of the nozzle region.

B4. The nozzle of any of paragraphs B0 through B3, wherein a first side wall of the pair of side walls is slidingly engaged with the bridge portion.

B5. The nozzle of paragraph B4, wherein the first side wall includes a pair of engagement arms extending from the upper end of the first side wall, the pair of engagement arms being configured to engage in a friction fit with corresponding engagement structures on the bridge portion.

B6. The nozzle of paragraph B4, wherein a second side wall of the pair of side walls is affixed to the bridge portion.

B7. The nozzle of any of paragraphs B0 through B6, wherein the side walls are configured to fit or wrap around an edge of a panel placed therebetween, the nozzle region being disposed adjacent to the edge of the panel, B8. The nozzle of any of paragraphs B0 through B7, wherein the injection port defines a first angle at a receiving end and a second angle at an ejecting end, the second angle being different from the first angle.

C0. A method for applying and shaping a viscous fluid on a panel edge, the method including: placing an adjustable applicator onto an edge of a panel such that the edge of the panel is between opposing walls of the applicator and below a bridge portion of the applicator, the bridge portion spanning the opposing walls; adjusting the opposing walls such that the opposing walls are in contact with opposing faces of the panel; injecting a viscous fluid into a port in the bridge portion of the applicator, such that the viscous fluid is deposited onto the edge of the panel; and moving the applicator along the edge of the panel, such that the viscous fluid is shaped into a selected cross section by an inner contour of the applicator.

C1. The method of paragraph C0, further including scraping excess fluid from one or more of the faces of the panel using one or more leading edges of the opposing walls of the applicator.

C2. The method of any of paragraphs C0 through C1, wherein placing the applicator onto the edge of the panel includes seating a flange of the applicator on the edge of the panel.

C3. The method of any of paragraphs C0 through C2, wherein adjusting the opposing walls includes squeezing the opposing walls toward each other.

C4. The method of any of paragraphs C0 through C3, wherein injecting the viscous fluid is performed while moving the applicator along the edge of the panel.

C5. The method of any of paragraphs C0, wherein the viscous fluid is shaped into the selected cross section in part by a sloping ceiling formed by the bridge portion.

C6. The method of paragraph C5, wherein the viscous fluid is shaped into the selected cross section in part by a widening channel formed by the opposing walls.

C7. The method of any of paragraphs C0 through C6, wherein moving the applicator along the edge of the panel includes maintaining at least a portion of the opposing walls in contact with the opposing faces of the panel.

Advantages, Features, Benefits

The different embodiments of a viscous fluid applicator described herein provide several advantages over known solutions for applying and shaping viscous fluid on an edge surface of a component, such as a machined CFRP panel.

For example, and among other benefits, illustrative embodiments include internal duct shapes and contours (e.g., nozzle regions) which flow the fluid such that it is in a stable shape upon exiting the device.

Additionally, and among other benefits, illustrative embodiments include only two parts, which may be squeezed together (e.g., by fingers) during use.

Additionally, and among other benefits, illustrative embodiments include a compliant or adjustable nozzle shaped to control fluid application depth and shape, including along curves, varying widths, and contours.

Additionally, and among other benefits, illustrative embodiments save labor hours by simplifying and standardizing a labor-intensive operation, thereby enabling gains in productivity and throughput.

No known system or device can perform these functions. Thus, the illustrative embodiments described herein are particularly useful for consistent, high-quality application and shaping of viscous fluids on edge surfaces of components such as panels (e.g., CFRP panels). However, not all embodiments described herein provide the same advantages or the same degree of advantage.

CONCLUSION

The disclosure set forth above may encompass multiple distinct examples with independent utility. Although each of these examples has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only.

We claim:

1. A variable-width nozzle for applying and shaping a viscous fluid, the nozzle comprising:

an applicator including an opposing pair of generally parallel side walls adjustable toward and away from each other, and a bridge portion spanning upper ends of the pair of side walls;

a nozzle region formed by inner surfaces of the bridge portion and the side walls; and an injection port formed in the bridge portion, such that an upper exterior of the bridge portion is in fluid communication with the nozzle region;

wherein the opposing pair of generally parallel side walls comprises a first applicator portion including a generally vertical first wall portion having a first inner face, and a second applicator portion including a generally vertical second wall portion having a second inner face, the second applicator portion slidably coupled with the first applicator portion, such that the first and second applicator portions are in an opposing spaced-apart arrangement;

wherein the bridge portion comprises a roof portion extending substantially orthogonally from the first wall portion; and wherein a seating member extends inwardly from at least one of the first and second inner faces, the seating member configured to contact an edge surface of a panel;

such that a bead of fluid on the edge surface of the panel is shaped into a selected cross section at least in part by a contour of the roof portion when the first and second applicator portions are passed along the panel with the seating member and at least a portion of the first and second inner faces in contact with the panel.

2. The device of claim 1, wherein the roof portion is angled such that a trailing end is configured to be closer to the panel than a leading end.

3. The device of claim 2, further comprising a horizontal portion at the trailing end of the roof portion, a lower surface of the horizontal portion configured to be a selected distance from the edge surface of the panel corresponding to a predetermined thickness of the bead of fluid.

4. The device of claim 1, the roof portion further comprising a keel member protruding downward from the roof portion, the keel member configured to contact the edge surface of the panel to maintain a predetermined spacing of the roof portion from the edge surface.

5. The device of claim 4, wherein the keel member has a hydrodynamic profile configured to allow recombination of fluid passing around the keel member before said fluid reaches an exit end of the roof portion.

6. The device of claim 1, the first applicator portion further comprising a ridge formed on the first inner face.

7. The device of claim 6, wherein the ridge forms a scraper disposed on a leading edge of the first wall portion, the scraper being configured to remove extraneous fluid from an adjacent major face of the panel.

8. The device of claim 2, wherein the port is configured to provide fluid communication between an exterior of the device and the edge surface of the panel.

9. The device of claim 8, wherein the port has a curved central axis.

10. The nozzle of claim 1, each side wall of the pair of side walls further including a scraper on a leading edge.

11. The nozzle of claim 1, wherein the injection port includes an opening in a ceiling portion of the nozzle region, and the ceiling portion slopes downward from the opening toward an exit portion of the nozzle region.

12. The nozzle of claim 11, wherein a contour of the ceiling portion transitions from sloped to flat at the exit portion of the nozzle region.

13. The nozzle of claim 1, wherein the side walls are configured to fit around an edge of the panel placed therebetween, the nozzle region being disposed adjacent to the edge of the panel.

14. The nozzle of claim 1, wherein the injection port defines a first angle at a receiving end and a second angle at an ejecting end, the second angle being different from the first angle.

* * * * *